US006332674B1

(12) United States Patent
Kamiyama et al.

(10) Patent No.: US 6,332,674 B1
(45) Date of Patent: Dec. 25, 2001

(54) INK CARTRIDGE AND A METHOD FOR SEALING AN APERTURE PROVIDED FOR SUCH CARTRIDGE

(75) Inventors: Yuji Kamiyama, Sapporo; Kazuaki Masuda, Kawasaki; Hajime Kaneko, Kodaira; Hiroaki Tanaka, Yokohama; Hiroyuki Ishinaga, Tokyo, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/021,944

(22) Filed: Feb. 11, 1998

Related U.S. Application Data

(62) Division of application No. 08/721,205, filed on Sep. 26, 1996.

(30) Foreign Application Priority Data

Sep. 29, 1995 (JP) ..... 7-276348

(51) Int. Cl.[7] ..... B41J 2/175
(52) U.S. Cl. ..... 347/86
(58) Field of Search ..... 347/86, 87; 156/73.1, 156/308.2, 308.4, 309.6, 293

(56) References Cited

U.S. PATENT DOCUMENTS

| | | | | |
|---|---|---|---|---|
| 4,968,998 | | 11/1990 | Allen | 347/7 |
| 5,509,140 | | 4/1996 | Koitabashi et al. | 347/86 |
| 5,537,134 | * | 7/1996 | Baldwin et al. | 347/85 |
| 5,701,995 | | 12/1997 | Higuma et al. | 206/347 |

FOREIGN PATENT DOCUMENTS

| | | | |
|---|---|---|---|
| 26 02 427 | | 7/1977 | (DE) . |
| 0 509 686 | | 10/1992 | (EP) . |
| 0 623 444 | | 11/1994 | (EP) . |
| 0 640 484 | | 3/1995 | (EP) . |
| 0 657 292 | | 6/1995 | (EP) . |
| 765 755 | * | 4/1997 | (EP) . |
| 1 066 292 | | 4/1967 | (GB) . |
| 06328712 | | 11/1994 | (JP) . |

* cited by examiner

*Primary Examiner*—N. Le
*Assistant Examiner*—Michael P. Nghiem
(74) *Attorney, Agent, or Firm*—Fitzpatrick, Cella, Harper & Scinto

(57) ABSTRACT

An ink cartridge for ink jet use is provided with an aperture for filling in the cartridge with ink. The circumference of the aperture and a part of a plug pressed in the aperture are fused and welded to be formed integrally to airtightly close the aperture, and obtain an integrated structure without any interface. Hence, it is made possible to reliably prevent ink from leaking therefrom, even if some scratches and cracks are present on both of them. This contributes to eliminating inspection steps to find ink leakage in the course of manufacture, and also, contributes to improving the yield of production. As a result, a significant reduction of costs is possible, while enhancing the reliability of the ink cartridge.

5 Claims, 5 Drawing Sheets

INK CARTRIDGE AND A METHOD FOR SEALING AN APERTURE PROVIDED FOR SUCH CARTRIDGE

This application is a division of application Ser. No. 08/721,205, filed Sep. 26, 1996, still pending.

BACKGROUND OF THE INVENTION

1. Field of the Invention

The present invention relates to an ink cartridge for ink jet use having an aperture serving as an opening for ink filling, which is sealed, and the invention relates to a method for sealing such aperture.

2. Related Background Art

As an ink cartridge suitable for use in the technical field of ink jet printing, the one having a structure shown in FIGS. 3A to 3C is known, for example. FIG. 3A is a cross-sectional view showing such ink cartridge. FIG. 3B is an enlarged sectional view showing the ink filling opening thereof. FIG. 3C represents FIG. 3B, observed from below in the direction indicated by an arrow in FIG. 3B.

In FIG. 3A, a reference numeral 300 designates an ink cartridge formed by polypropylene (PP) or the like, for example. The ink cartridge 300 substantially comprises a container 302 for a member that generates negative pressure, which is partitioned by a partitioning wall 301, and an ink container 303. The container 302 for a member that generates negative pressure and the ink container 303 are conductively connected through a conductive aperture 304. For the container 302 for a member that generates negative pressure, an ink supply port 305 is formed to supply ink to an ink jet head (not shown) that can be mounted on an ink cartridge. On one wall of the container 302 for a member that generates negative pressure, where the ink supply port 305 is formed, an air conduit hole 305 is arranged away from the ink supply port. In the interior of the container 302 for a member that generates negative pressure, a negative pressure generating member 307 formed by a porous element or the like is contained to absorb and hold ink, while ink is contained directly in the interior of the ink container arranged adjacent to it. For this ink container 303, an ink filling port 309 is formed as an aperture to fill in the container with ink directly.

As shown in FIG. 3D, the ink filling port 309 substantially comprises a recessed portion 309*a* where a plug, to be described later, is inserted under pressure to airtightly close the ink filling port 309; and an aperture 309*b* formed on the bottom of the recessed portion 309*a* and arranged to be conductively connected with the ink container 303. A plug 310 that can be inserted into the recessed portion 309*a* is usually a metallic ball of SUS or the like or a plastic ball of PP or the like. Then, a ball of the kind is inserted into the ink filling port 309 under pressure after the ink container is filled with ink, thus keeping the ink filling port in a state of being sealed.

Ink is filled into the ink cartridge structured as described above from the aperture 309*b* of the ink filling port 309. As a method therefor, it is possible to adopt any one of the known methods, such as applying pressure or reducing pressure, among others.

After ink is filled, ink cartridges are often distributed on the market individually. In this case, all the apertures of the ink cartridge including the ink filling port 309 (and the ink supply port 305 and the air conduit hole 306, for example) should be closed by sealing material as a preventive measure against the evaporation of ink and the expansion of air in the container. (Here, the ink filling port 309 is sealed by the plug 310 as described above.)

As a sealing material to be used preferably for closing such apertures as described above, it is possible to use a compound material produced by combining a single layered barrier, which is called a "barrier material" in the field of packaging industry, and a multi-laminated plastic film, or a compound barrier material produced by combining this compound material and a reinforcing material, such as paper or fabrics or by combining it with aluminum foil or the like. Particularly, using the same material as that of an ink cartridge as an adhesive layer, it becomes possible to maintain a higher airtightness when the sealing material is thermally welded to the ink supply port 305, and the air conduit hole 306, which also provide apertures for an ink cartridge.

As described above, the ink filling port 309, ink supply port 305, and air conduit hole 306 are airtightly sealed. Therefore, there is no ink leakage or the like, and extremely high reliability is obtainable when the ink cartridge 301 is distributed on the market individually.

Now, in this respect, the SUS ball used for pressurized insertion to the ink filling port of an ink cartridge of the kind is prepared for the intended process only after a severe selection so that the acceptable ball should have no scratches or cracks on the surface or any other defects. Therefore, it is required to take many steps when selecting the balls, leading to a disadvantage that the costs become inevitably high. Also, the SUS balls, which are made available after a severe selection process, may sometimes present the scratches or cracks that cannot be discriminated by eye-sight. If such SUS balls should be used, it is conceivable that the provision of any perfect durability is hindered or there may be produced ink tanks, which are unable to fit for use in the environments subjected to changes. A problem that scratches and the others cannot be discriminated perfectly by eye-sight is equally encountered when using PP balls. The scratches and others may exist in the interior of the ink filling port, too.

Here, the following is regarded as causes of the generation of these scratches and others:

As the causes of scratches in the interior of the ink filling port are:

1) Welded lines created when forming an ink tank.

2) Scratches created by rubbing when the ink filling port is being pressed by the ink filling mouth of an ink filling machine.

Also, for the causes of scratches on the surface of the plug:

1) Scratches created by rubbing of one plug with another when being distributed on the market.

2) Welded lines created when forming a plug.

If a plug having such scratches and others is pressed in the ink filling port described above, ink may leak from the ink filling port or it becomes impossible to keep the ink container airtightly closed. As a result, the performance of an ink cartridge cannot be anticipated as desired, and then, conceivably, ink is caused to shift into a negative pressure generating member in the container for such member. Therefore, ink may leak from the ink supply port. In order to prevent such ink cartridge from being distributed on the market, it should be necessary to exercise an inspect by leaving the ink tank for a period of 8 to 24 hours with the ink filling port being placed downward after the ink filling port, ink supply port, and air conduit hole are sealed or to adopt an inspection method in which the ink tank is left in a dry preservation equipment at 45° C. or at 60° C. With an inspection of the kind, ink leakage from the ink filling port is noticed if any fine leakage takes place in the ink filling port or a phenomenon is observable that the portion of the negative pressure generating member, which is not wet by ink usually, is wet by ink sucked up by means of capillary force of the negative pressure generating member. Thus, those cartridge presenting ink leakage can be checked and excluded while still in the manufacturing stage. However, the execution of these inspecting steps to find ink leakage from the ink filling port not only results in the elongated production tact, but also, results in the reduced yield due to the defective products thus excluded. The costs of manufacture rises inevitably.

Therefore, it has been studied to apply a thermal welding method to a PP ball after it is pressed in the filling port for sealing it. However, with the usual thermal welding method, heat cannot be concentrated in the vicinity of the ink filling port for the intended thermal welding. The heat tends to affect the other portions of the ink cartridge, leading to the thermal influence exerted on the ink that has been contained. Also, there is a possibility that an adverse effect is produced on the reliability of the airtightness of the ink tank itself eventually.

SUMMARY OF THE INVENTION

It is an object of the present invention to provide a welding method capable of performing a welding locally within a limited range so as not to produce any adverse effect on the entire body of a product.

It is another object of the invention to provide a method for sealing the apertures of the ink cartridge for ink jet use to reliably prevent ink from leaking from the apertures of ink filling ports and others, and also, to provide an inexpensive ink cartridge for ink jet use formed by the application of such method.

It is still another object of the invention to provide an ink cartridge for ink jet use having a larger amount of ink that can be filled in it by making the aperture space smaller for the ink filling port and others.

It is a further object of the invention to provide a method for sealing the aperture of an ink cartridge for ink jet use having the aperture arranged therefor, including the steps of inserting a plug under pressure into the aperture; compressing a welding horn to the upper part of the plug to exert twisting vibration around the axis of the aperture in order to fuse the plug to be integrated with the inner wall of the aperture; and cooling the integrally fused portion after retracting the welding horn from such portion.

It is still a further object of the invention to provide a method for sealing the aperture of an ink cartridge for ink jet use by fusing a plug positioned in an inserted state in order to airtightly close the outer aperture.

It is another object of the invention to provide a method for sealing the aperture of an ink cartridge for ink jet use having the aperture arranged therefor, including the steps of inserting a plug under pressure into the aperture so that the upper part of the plug is exposed from the aperture; compressing a welding horn to the upper part of the plug to exert twisting vibration around the axis of the aperture in order to fuse the plug to be integrated with the circumference of the aperture; and cooling the integrally fused portion after retracting the welding horn from such portion.

It is still another object of the invention to provide a method for sealing the aperture of an ink cartridge for ink jet use by fusing the circumference of the aperture integrally with a part of a plug inserted into the aperture under pressure.

It is a further object of the invention to provide an ink cartridge for ink jet use having an aperture therefor wherein the aperture is arranged to fill in it with ink;

or to provide an ink cartridge for ink jet use wherein the material of the plug is the same as the material of the circumference of the aperture;

or to provide an ink cartridge for ink jet use wherein the melting point of the material of the plug is the same as that of the material of the circumference of the aperture;

or to provide an ink cartridge for ink jet use wherein the aperture is formed for an ink container that contains ink directly;

or to provide an ink cartridge for ink jet use wherein a container for a member that generates negative pressure is arranged adjacent to the ink container, which contains a negative pressure generating member to absorb and hold ink in it, and then, the ink container and the container for such member are conductively connected by use of gas-liquid exchanging means;

or to provide an ink cartridge for ink jet use wherein the plug positioned in the inserted condition is fused, and then, the outer aperture is airtightly closed.

With the structure described above, it is possible to provide an integrated structure without any interface by the utilization of friction heat to fuse and weld the plug to the ink filling port after the plug is pressed in it unlike the conventional structure where an interface exists because of the fitting of a plug that is just pressed in the ink filling port. Hence, the airtightness of the ink filling port can be held reliably, while the production yield is improved, making it possible to reduce the costs of manufacture significantly.

Also, with the structure described above, the ink container provided with the ink filling port is fixed by means for fusing the plug to be welded to the ink filling port by the utilization of friction heat, and then, only a part of the plug is fused by the friction heat to make the plug integrally formed with the circumference of the ink filling port or with its inner face by use of resin thus fused in order to airtightly close the ink filling port. Therefore, the portion integrally formed by fusion welding can be made smaller. Accordingly, it is possible to increase the amount of ink to be filled in the container to the extent that such portion needed for ink filling is made smaller, and to enhance the efficiency of ink consumption per ink cartridge.

Also, with this method, only the limited portion is fused to be welded. Therefore, there is no possibility that the other structural parts of the ink tank, and ink filled in the container are affected by such fusion welding.

Ink may be present in the vicinity of an ink filling port if the ink filling rate inside the container so as to improve an using efficiency of ink for an ink jet cartridge and prevent ink from jetting out caused by the expansion of internal air when the package is opened at the change of environment (particularly, when the atmospheric pressure decreases and the temperature rises). When the ink filling port is closed, a plug is inserted into the port under pressure and the port is preliminarily sealed and then the fusion bonding is performed by the frictional heat. Accordingly, the frictional force and the vibration is not applied without the preliminary sealing so that ink is not splattered in the vicinity of the ink filling port, thus remarkably improving the productivity.

DETAILED DESCRIPTION OF THE PREFERRED EMBODIMENTS (Embodiment 1)

Figure 1A:
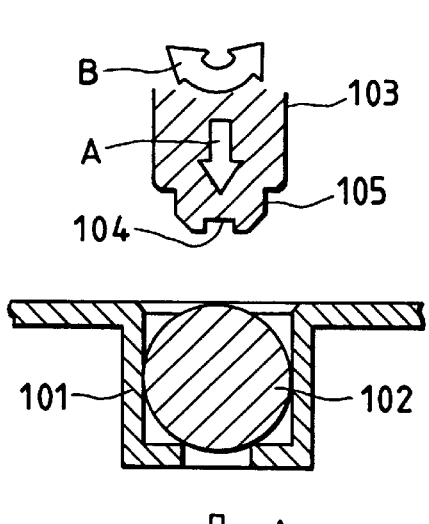
FIGS. 1A, 1B, 1C, 1D and 1E are views illustrating each operation of a method for sealing the aperture of an ink cartridge for ink jet use until a plug is fused and welded to the ink filling port in accordance with one mode embodying the present invention.
Figure 1B:
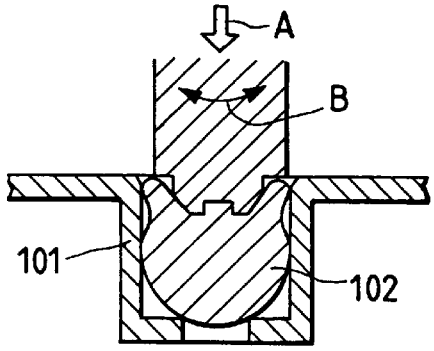
Figure 1C:
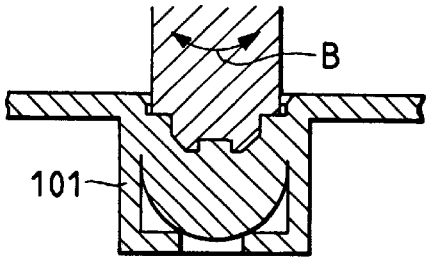
Figure 1D:
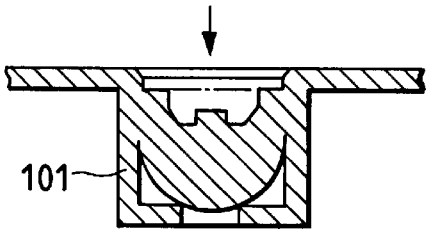
Figure 1E:
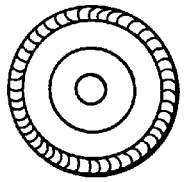
Figure 3A:
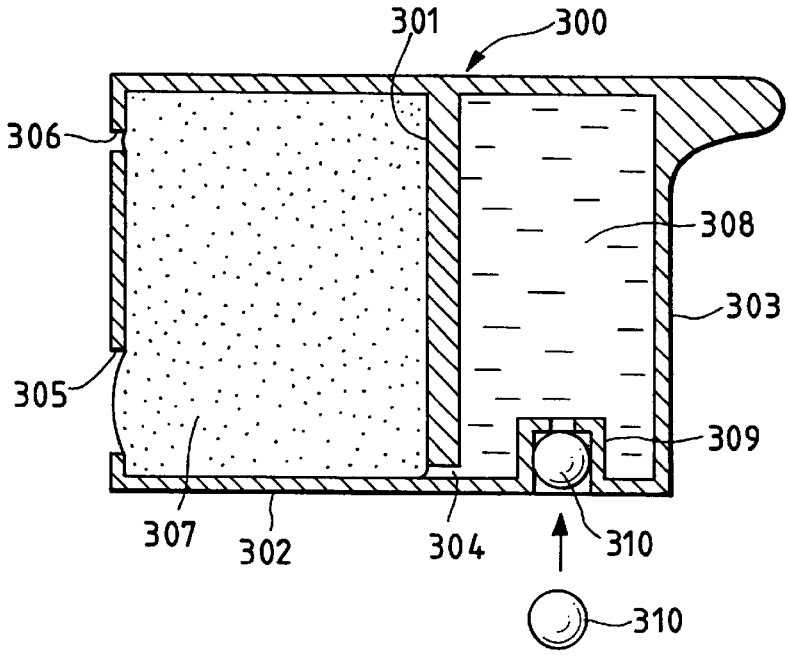
FIGS. 3A, 3B and 3C are cross-sectional views showing one example of the ink cartridge for ink jet use to which the method of present invention is applicable for sealing the aperture thereof.

FIGS. 1A to 1E are cross-sectional views showing a method for sealing the aperture of an ink cartridge for ink jet use in accordance with one mode embodying the present invention, respectively. FIG. 1A is a cross-sectional view showing the state where an ink filling port is plugged, and also, a welding horn. FIG. 1B is a cross-sectional view showing the operation to fuse the plug by use of the leading end of the welding horn. FIG. 1C is a cross-sectional view showing the operation to fuse and weld the plug and the ink filling port by use of the intermediate section of the welding horn. FIG. 1D is a cross-sectional view showing the state where the plug is fused and welded to the ink filling port. FIG. 1E is a view showing FIG. 1D, observed in the direction indicated by an arrow in FIG. 1D. Here, in the present mode embodying the invention, the same reference marks are applied to the same elements as those represented in FIGS. 3A to 3C, and the description thereof will be omitted.

In FIGS. 1A to 1E, a reference numeral 101 designates an ink filling port to fill in the ink cartridge with ink; 102, a plug to be pressed in the ink filling port 101; and 103, a welding horn to fuse and weld the plug 102 with the inner face of the ink filling port 101.

Here, the description will be made of an ink filling and a closing operation thereafter.

At first, an ink injection outlet (not shown) is pressed in the ink filling port 101 of an ink cartridge to inject a given amount of ink into the cartridge under pressure. Then, after the ink injection, the ink supply port 305 and the air conduit hole 306, which are the other apertures of the ink container than the ink filling port 101, are airtightly closed by a sealing material such as silicon rubber. In this state, the ink injection outlet is removed from the ink filling port 101.

Subsequently, immediately after the removal of the ink injection outlet, the plug 102 is pressed in as shown in FIG. 1A to fit it with the ink filling port 101. It is preferable to make the plug 102 spherical in consideration of the convenience of a pressure-in device and handling. Also, it is most preferable to use the same material of the ink container for the plug 102.

Then, As shown in FIG. 1B, the welding horn 103 is arranged in a position facing the center line of the ink filling port 101, and allowed to descend along the center line of the ink filling port 101 in the direction indicated by an arrow A. Immediately before the horn abuts upon the upper portion of the plug 102, oscillation begins in the twisting directions (indicated by arrows B). The amplitude of this oscillation can be variable within a range of 0.05 to 0.1 mm. The frequency thereof is within 10 kHz to 30 kHz. Thus, the plug 102 is fused by the leading end of the welding horn 103. In this respect, the most preferable condition of the fusion welding is: the amplitude is 0.08 mm at an oscillating frequency of 18 kHz, which is optimal.

Since the leading end 104 of the welding horn 103 oscillates in the twisting directions (indicated by arrows B), friction heat is generated on the portion where the plug 102 and the leading end 104 of the welding horn 103 are in contact to fuse the plug 102.

Then, as shown in FIG. 1C, the plug 102 is fused by the leading end 104 of the welding horn 103. The resin thus fused is blocked by the intermediate section 105 of the welding horn, and welded to the inner face portion of the ink filling port 101 by the application of friction heat being generated by the intermediate section 105 of the welding horn 103. In this way, the ink filling port 101 and the plug 102 are formed integrally without any interface between them.

Lastly, as shown in FIGS. 1D and 1E, the welding horn 103 shifts upward to complete the fusion welding. Thus, the plug 102 is fused and welded to the ink filling port 101 to form an integral structure without any interface. Therefore, it is possible to reliably prevent ink from leaking due to the scratches or cracks that may exist on the plug 102 and the ink supply port 101. Further, there is no need for any steps of inspection to find ink leakage, thus making it possible to reduce the costs of manufacture.

Also, the welding is locally possible only on the portion that needs it. Hence, there is no adverse effect to be produced on any other portions of the structure.

(Embodiment 2)

Figure 2A:
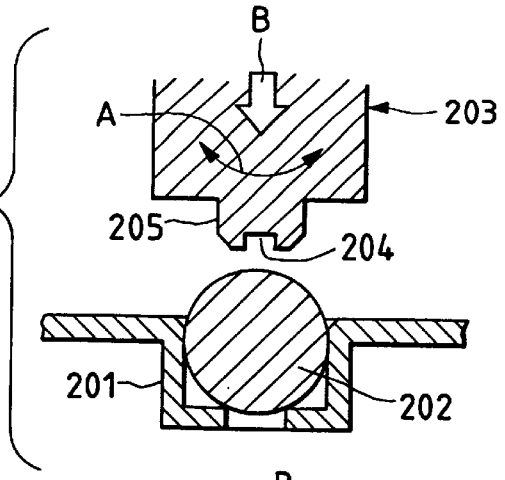
FIGS. 2A, 2B, 2C, 2D and 2E are views illustrating each operation of a method for sealing the aperture of an ink cartridge for ink jet use until a plug is fused and welded to the ink filling port in accordance with another mode embodying the present invention.
Figure 2B:
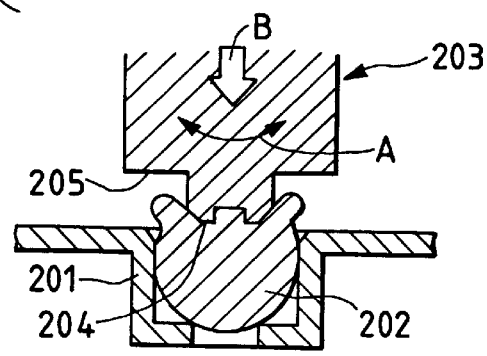
Figure 2C:
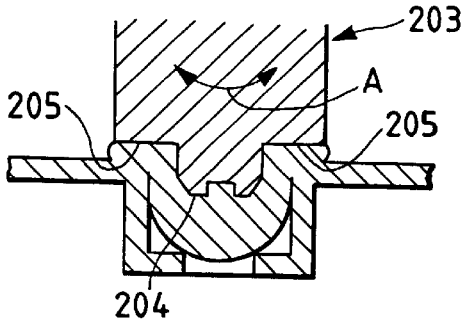
Figure 2D:
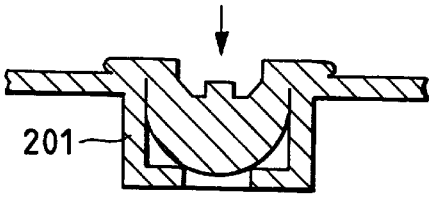
Figure 2E:
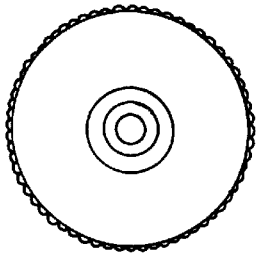

FIGS. 2A to 2E are cross-sectional views showing a method for sealing the aperture of an ink cartridge for ink jet use in accordance with another mode embodying the present invention, respectively, and illustrating each of the operations until a plug is fused and welded to an ink filling port. Here, the welding position of the plug to the ink filling port is modified to be outside the ink container. FIG. 2A is a cross-sectional view showing the state where an ink filling port is plugged, and also, a welding horn. FIG. 2B is a cross-sectional view showing the operation to fuse the plug by use of the leading end of the welding horn. FIG. 2C is a cross-sectional view showing the operation to fuse and weld the plug and the ink filling port by use of the intermediate section of the welding horn. FIG. 2D is a cross-sectional view showing the state where the plug is fused and welded to the ink filling port. FIG. 2E is a view showing FIG. 2D, observed in the direction indicated by an arrow in FIG. 2D. Here, in the present mode embodying the invention, the same reference marks are also applied to the same elements as those represented in FIGS. 1A to 1E and FIGS. 3A to 3C, and the description thereof will be omitted.

In FIGS. 2A to 2E, a reference numeral 201 designates an ink filling port to fill in the ink cartridge with ink; 202, a plug to be pressed in the ink filling port 201; and 203, a welding horn to fuse and weld the plug 202 with the inner face of the ink filling port 201.

Unlike the previous mode embodying the present invention, the upper part of the plug 202 pressed in the ink filling port 201 is protruded from the ink filling port 201 in this mode. Also, the intermediate section 205 of the welding horn 203 is configured to extrude it largely outward. These aspects characterize this mode embodying the present invention.

Here, after the ink injection is conducted as in the previous mode, the welding horn 203 descends as shown in FIG. 2A and FIG. 2B in the same manner as in the previous mode to fuse the protruded upper part of the plug 202 by the leading end 204 of the welding horn 203.

Then, as shown in FIG. 2C, the resin, which is fused by the leading end 204 of the welding horn 203, is blocked by the intermediate section 205 of the welding horn, and welded on the circumference of the upper portion of the ink filling port 201 by the application of friction heat being generated by the intermediate section of the welding horn. In this way, the ink filling port 201 and the plug 202 are formed integrally without any interface between them.

Lastly, as shown in FIGS. 2D and 2E, the welding horn 203 shifts upward to complete the fusion welding. Thus, the plug 202 is fused and welded on the upper circumference of the ink filling port 201 to form an integral structure without any interface. Therefore, it is possible to reliably prevent ink from leaking due to the scratches or cracks that may exist on the plug 202 and the ink supply port 201. Further, there is no need for any steps of inspection to find ink leakage, thus making it possible to reduce the costs of manufacture. Moreover, since the plug 202 can be fused and welded in the state where it protrudes upward from the ink filling port 201, the space provided for the ink filling port that occupies the ink container is made smaller, hence increasing the filling amount of ink accordingly.

Figure 4A:
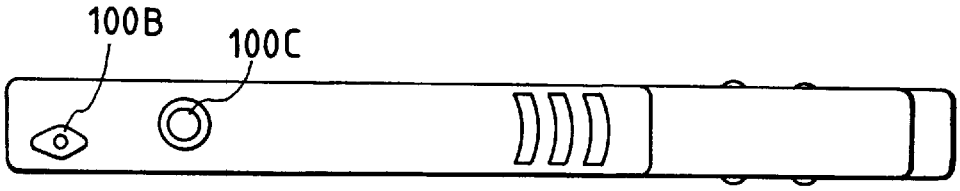
FIGS. 4A, 4B and 4C are views showing the contour of the other, ink cartridge for ink jet to which the opening sealing method according to the present invention may be applied.
Figure 4B:
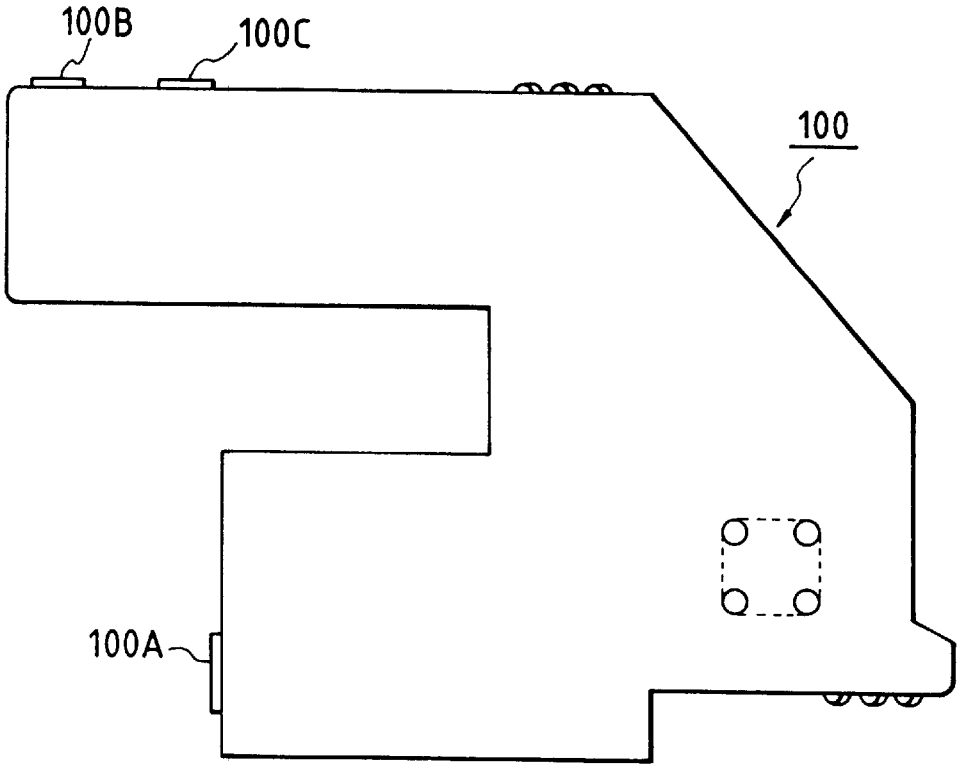
Figure 4C:
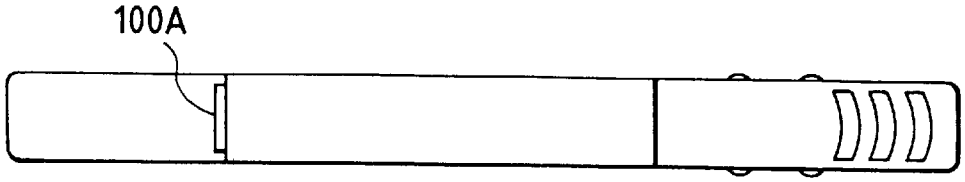
Figure 5:
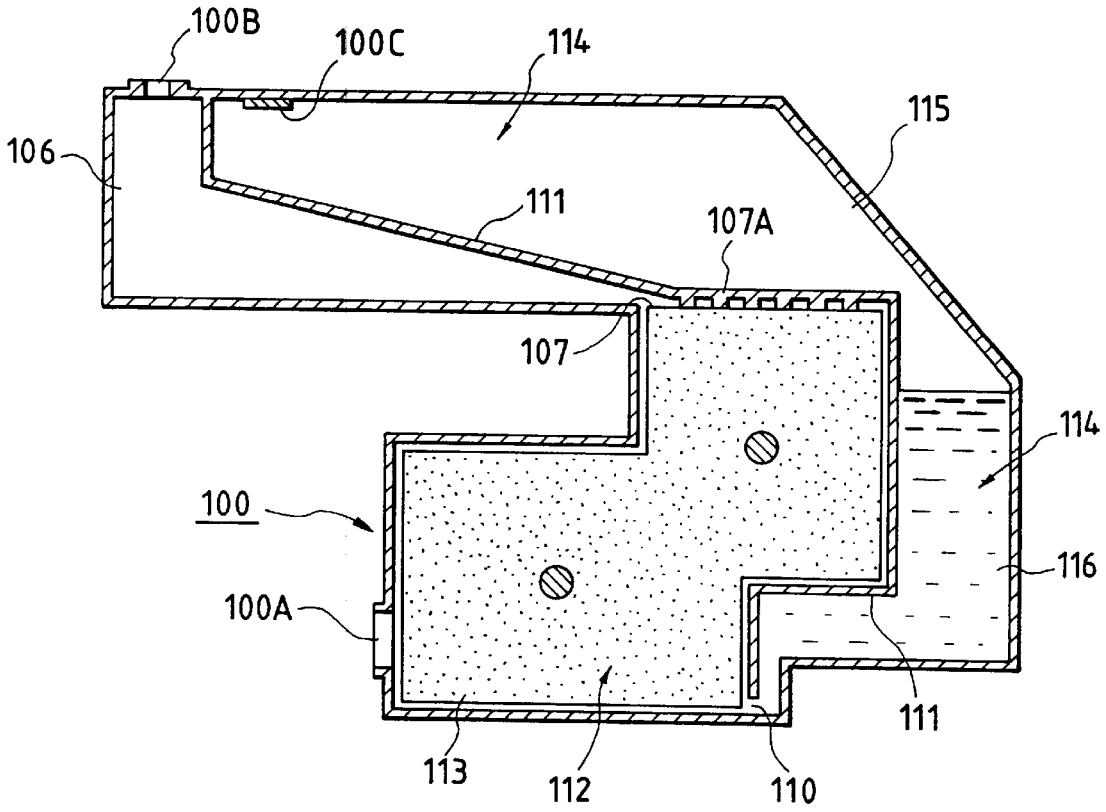
FIG. 5 is a cross-sectional view showing the contour of the other ink cartridge for ink jet to which the opening sealing method according to the present invention may be applied.

FIGS. 4A to 4C are three-side views showing the appearance of an ink cartridge according to other embodiment to which the present invention may be applied, and FIG. 5 is a cross-sectional view typically showing its inside.

As shown in FIGS. 4A to 5, the ink cartridge 100 of this embodiment presents an appearance almost like a U-shaped character, with a constant width. Provided at one end of the U-shaped character shape on the bottom is an ink supply port 100A, which is thereby connected with an ink supply tube of an ink-jet head (not shown) for the supply of the ink. Also, provided above the U-shaped character shape is an atmosphere communication opening 100B, thereby relieving pressure variations within the ink cartridge to maintain its internal pressure substantially constant. An ink inlet port 100C is provided to fill the ink via this ink inlet port when manufacturing the ink cartridge.

As shown in FIG. 5, the ink cartridge of this embodiment is largely divided into two chambers. That is, formed inside this ink cartridge is a partition wall 111 which is substantially at an angle in an upper portion of the cartridge, and runs substantially like a crank in the lower portion, the ink cartridge 100 being divided into two chambers, an ink containing portion 114 and a negative pressure generating receiving portion 112, and spaces 106, 107. A communication channel 110 is provided at the lower end of the partition 111, and a gas and liquid exchanging groove (not shown) is provided on the partition 111 in the vicinity thereof.

The ink containing portion 114 which is one chamber of the ink cartridge 100 is filled with the ink 116 at the initial time of use. Along with the ink consumption the gas (air) is introduced from the negative pressure generating member receiving portion which is the other chamber via the communication channel 110 by the exchange between gas and liquid, as will be described later, so that the air 115 gradually increases in volume.

The negative pressure generating member receiving portion 101 which is the other chamber and the spaces 106, 107 are constituted as follows. The negative pressure generating member receiving portion 101 is densely packed with an ink holding member 113 by conforming with the shape of its receiving portion. This ink holding member 113 is formed of a porous material like sponge to generate an apparent negative pressure relative to atmospheric pressure owing to its capillary force. Provided on the upper portion of the negative pressure generating member receiving portion 112 is a space 107 having a member 107A for regulating the displacement of the ink holding member 113 disposed along the upper portion of the member 113 packed. Further, a space 106 in communication with this space 107 and leading to an atmosphere communication opening 100B is provided. This space 106 has a substantially triangular shape with its volume gradually increasing toward the atmosphere communication opening 100B.

In the ink cartridge with the above constitution, if the ink is consumed by e.g. being discharged by an ink-jet head (not shown), the ink is supplied via the supply port 100A to the ink-jet head, but there may occur a non-uniform pressure distribution within the ink holding member 113. And to make up for this non-uniform pressure distribution, the ink is moved from the ink containing portion 114 via the communication channel 110 to the ink holding member 113. Then, the air 115 within the ink containing portion 103 undergoes a decrease in pressure (an increase in volume) corresponding to the above movement of the ink, but this decrease in pressure can be offset as the air introduced via the atmosphere communication opening 100B into the ink cartridge 100 is finally conducted via the gas and liquid exchanging groove (not shown) of the partition 111 in contact with the ink holding member and the communication channel 110 to the ink containing portion 103.

With the constitution of gas and liquid exchange as above described, if the ink within the ink containing portion 114 is used up, the ink held by the ink holding member 113 is then gradually consumed.

As described above, in accordance with the present invention, the plug is fused and welded in the ink filling port. Therefore, it is possible to reliably prevent ink from leaking due to the scratches or cracks that may exist on the plug and the ink supply port. Further, there is no need for any steps of inspection to find ink leakage, thus making it possible to reduce the costs of manufacture.

Also, since the plug can be fused and welded on the upper circumference of the ink filling port to form the structure integrally without any interface, the space provided for the ink filling port that occupies the ink container can be made smaller thereby to increase the amount of ink usable in the ink container accordingly, and also, improve the efficiency of ink consumption.

Also, the welding is locally effectuated only on the portion that needs it. There is no adverse effect to be produced on any other portions of the structure of an ink cartridge.

After the plug is inserted into the port under pressure and the port is preliminarily sealed and then the fusion bonding is performed by the frictional heat. Accordingly, the frictional force and the vibration is not applied without the preliminary sealing so that ink is not splattered in the vicinity of the ink filling port, thus improving the sealing properties.

The plug of the embodiments is a resin ball. However, the plug may be a flat disk as the ink filling port 100C shown in FIG. 5. If the sealing properties can be improved, other shapes such as rectangular may be also used. The material of the plug may be other material which may be fused and sealed other than the resin. In addition, the plug may be made not only a single member but also with a plug made by a core with the periphery thereof covered with the fusible material. The core is made from the different material.

Furthermore, the plug may be preferably fused and integral with a part of the container so as to improve the sealing properties. However, the plug may be partially integral with the container with a border surface. Either of the plug and the container may be fused. Even in this case, the sealing method as mentioned above according to present invention may be also applied. In the preceding embodiments, the torsion vibration fusion bonding is used. However, the ultrasonic fusion bonding in which the material itself generates the friction heat may be also used.

What is claimed is:

1. A method for sealing an ink filling aperture of an ink cartridge usable for ink jet recording, the ink filling aperture having a cylindrical concave portion formed of resin, comprising the steps of:

inserting a plug member formed of a resin having a spherical surface in said ink filling aperture under pressure after filling ink through said ink filling aperture, such that the spherical surface of the resin plug member and the cylindrical concave portion of the resin ink filling aperture contact at a first contact portion;

positioning a welding horn to said plug member extending outwardly from said ink filling aperture;

rotating said welding horn about an axis of said ink filling aperture relative to said plug member; and fusion welding said resin plug member to said resin ink filling aperture by said rotating step, such that a second contact portion different from said first contact portion is newly formed between said resin plug member and said resin ink filling aperture.

2. A method according to claim 1, further comprising a step of retracting said welding horn and cooling said welding of said plug member and said aperture.

3. A method according to claim 1, wherein said fusion welding is executed so as to weld said plug member to said aperture at an inner wall of said aperture.

4. A method according to claim 1, wherein said fusion welding is executed so as to weld said plug member to said aperture at a circumference of said aperture.

5. A method according to claim 1, wherein in said step of rotating said welding horn relative to said plug member, said plug member remains stationary relative to said ink filling aperture.

* * * * *

UNITED STATES PATENT AND TRADEMARK OFFICE

CERTIFICATE OF CORRECTION

PATENT NO. : 6,332,674 B1
DATED : December 25, 2001
INVENTOR(S) : Yuji Kamiyama et al.

It is certified that error appears in the above-identified patent and that said Letters Patent is hereby corrected as shown below:

Title page,
Item [56], References Cited, U.S. PATENT DOCUMENTS, Insert
-- 5,658,408 8/1997 Frantz et al. …….156/64
5,298,098 3/1994 Hoedl ……..156/73.1 --.

FOREIGN PATENT DOCUMENTS,
"06328712" should read -- 6-328712 --.

Figure 3B:
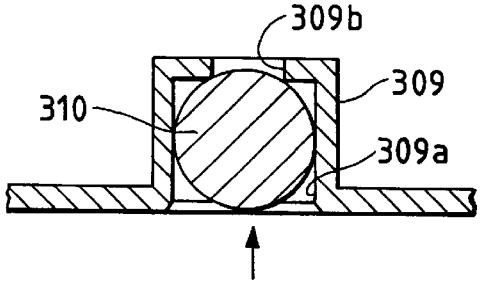
Figure 3C:
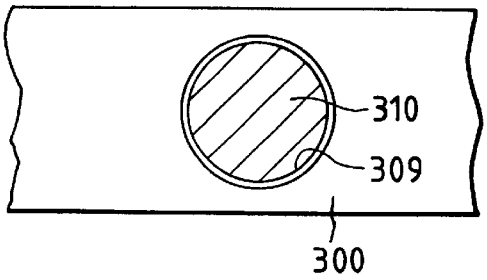

Column 1,
Line 45, "FIG. 3D," should read -- FIG. 3B, --.

Column 2,
Line 35, "unable to fit" should read -- unfit --.

Column 3,
Line 9, "cartridge" should read -- cartridges --; and
Line 13, "tact," should read -- time, --.

Column 4,
Line 52, "so" should read -- is regulated so --.

Column 5,
Line 14, "other," should read -- other --.

Column 7,
Line 32, "other" should read -- another --.

UNITED STATES PATENT AND TRADEMARK OFFICE

CERTIFICATE OF CORRECTION

PATENT NO. : 6,332,674 B1
DATED : December 25, 2001
INVENTOR(S) : Yuji Kamiyama et al.

It is certified that error appears in the above-identified patent and that said Letters Patent is hereby corrected as shown below:

Column 8,
Line 57, "sealed and then the fusion bonding" should read -- sealed, fusion bonding is then --; and
Line 58, "is" should be deleted.

Signed and Sealed this

Twenty-second Day of October, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,332,674 B1
DATED : December 25, 2001
INVENTOR(S) : Yuji Kamiyama et al.

It is certified that error appears in the above-identified patent and that said Letters Patent is hereby corrected as shown below:

Title page,
Item [56], References Cited, U.S. PATENT DOCUMENTS, insert
-- 5,658,408 8/1997 Frantz et al. …….. 156/64
5,298,098 3/1994 Hoedl …….. 156/73.1 --.

FOREIGN PATENT DOCUMENTS,
"06328712" should read -- 6-328712 --.

Column 1,
Line 45, "FIG. 3D," should read -- FIG. 3B, --.

Column 2,
Line 35, "unable to fit" should read -- unfit --.

Column 3,
Line 9, "cartridge" should read -- cartridges --; and
Line 13, "tact," should read -- time, --.

Column 4,
Line 52, "so" should read -- is regulated so --.

Column 5,
Line 14, "other," should read -- other --.

Column 7,
Line 32, "other" should read -- another --.

UNITED STATES PATENT AND TRADEMARK OFFICE

CERTIFICATE OF CORRECTION

PATENT NO. : 6,332,674 B1
DATED : December 25, 2001
INVENTOR(S) : Yuji Kamiyama et al.

It is certified that error appears in the above-identified patent and that said Letters Patent is hereby corrected as shown below:

Column 8,
Line 57, "sealed and then the fusion bonding" should read -- sealed, fusion bonding is then --; and
Line 58, "is" should be deleted.

Signed and Sealed this

Twenty-ninth Day of October, 2002

*Attest:*

*Attesting Officer*

JAMES E. ROGAN
*Director of the United States Patent and Trademark Office*